US012780509B2

(12) United States Patent
Tamarit Rios

(10) Patent No.: US 12,780,509 B2
(45) Date of Patent: Nov. 3, 2026

(54) CAP FOR A LIQUID CONTAINER

(71) Applicant: DESARROLLOS TAMARIT PLAZA SL, Valencia (ES)

(72) Inventor: Ramón Tamarit Rios, Valencia (ES)

(73) Assignee: DESARROLLOS TAMARIT PLAZA SL, Valencia (ES)

( * ) Notice: Subject to any disclaimer, the term of this patent is extended or adjusted under 35 U.S.C. 154(b) by 136 days.

(21) Appl. No.: 18/837,316

(22) PCT Filed: Feb. 11, 2022

(86) PCT No.: PCT/ES2022/070070
§ 371 (c)(1),
(2) Date: Aug. 9, 2024

(87) PCT Pub. No.: WO2023/152408
PCT Pub. Date: Aug. 17, 2023

(65) Prior Publication Data

US 2026/0125190 A1 May 7, 2026

(51) Int. Cl.
*B65D 47/32* (2006.01)
*B65D 47/08* (2006.01)

(52) U.S. Cl.
CPC ..... *B65D 47/32* (2013.01); *B65D 47/0857* (2013.01); *B65D 2205/02* (2013.01); *B65D 2547/066* (2013.01)

(58) Field of Classification Search
None
See application file for complete search history.

(56) References Cited

U.S. PATENT DOCUMENTS

| | | | | |
|---|---|---|---|---|
| 4,838,441 | A * | 6/1989 | Chernack | B65D 47/0838 222/153.1 |
| 7,044,316 | B1 * | 5/2006 | Hsu | A61J 11/0005 215/11.1 |
| 7,975,883 | B2 * | 7/2011 | Laib | B65D 47/0895 222/484 |
| 10,457,450 | B2 * | 10/2019 | Rios | B65D 47/0804 |
| 11,325,758 | B2 * | 5/2022 | Sahara | B65D 47/123 |
| 11,807,427 | B2 * | 11/2023 | Sakamoto | B65D 47/2018 |
| 2006/0201976 | A1 * | 9/2006 | Bloom | B65D 47/2031 222/494 |

(Continued)

FOREIGN PATENT DOCUMENTS

| | | | | |
|---|---|---|---|---|
| WO | 2013/171351 | A1 | 11/2013 | |
| WO | WO-2023152408 | A1 * | 8/2023 | B65D 43/16 |

OTHER PUBLICATIONS

International Search Report for PCT/ES2022/070070 dated Sep. 27, 2022 (PCT/ISA/210).

(Continued)

*Primary Examiner* — Paul R Durand
*Assistant Examiner* — Michael J. Melaragno
(74) *Attorney, Agent, or Firm* — Sughrue Mion, PLLC

(57) ABSTRACT

The invention relates to a cap for consuming a liquid from a container which comprises at least one orifice for the outlet of liquid from the container and at least one orifice for the inlet of air into the container, said air inlet orifice incorporating a one-way valve that allows air to enter but does not allow liquid to come out through the same.

15 Claims, 10 Drawing Sheets

(56) References Cited

U.S. PATENT DOCUMENTS

| | | | | |
|---|---|---|---|---|
| 2011/0297698 | A1* | 12/2011 | Chiang | B65D 47/08 220/373 |
| 2013/0037510 | A1* | 2/2013 | Tamarit Rios | B65D 47/32 215/259 |
| 2015/0375909 | A1* | 12/2015 | Rios | A47G 19/2272 222/482 |
| 2020/0270026 | A1* | 8/2020 | Stratton | B65D 47/32 |

OTHER PUBLICATIONS

Written Opinion for PCT/ES2022/070070 dated Sep. 27, 2022 (PCT/ISA/237).

* cited by examiner

CAP FOR A LIQUID CONTAINER

CROSS REFERENCE TO RELATED APPLICATIONS

This application is a National Stage of International Application No. PCT/ES2022/070070 filed Feb. 11, 2022.

OBJECT OF THE INVENTION

The present invention relates to a cap with a one-way valve for a liquid container, preferably a cap of the type that is coupled to an opening of the container, such as PET bottles, although it can also be used in other types of containers, such as the bottles used by cyclists or athletes. In particular, the cap described in the application is applicable to a liquid container and comprises a mouthpiece for the outlet of the liquid that rises from a surface which also incorporates an orifice with a one-way valve that allows air to enter inside the container, but prevents the liquid from coming out from inside the same. The cap also incorporates a perimeter wall to fit the cap on the opening of the liquid container. The cap of the present invention allows air to access the orifice with the one-way valve without interruption, i.e., maintaining the air supply, even when this orifice is blocked by the user's lips when said user inserts the mouthpiece into his or her mouth to drink.

This invention is applicable in the sector of closures for liquid containers, and in particular closures of containers for beverages, mainly water, isotonic drinks, soft drinks and juices, as well as receptacles for sauces and other food products, which are liquid or partially liquid, among others.

BACKGROUND OF THE INVENTION

In the state of the art, closure devices for liquid containers are known which incorporate an orifice for the outlet of liquid from the container and an orifice for the inlet of air into the same, such that said air inlet makes it easier for the liquid to come out. Examples of said closure devices are used in cups or bottles with a large diameter, especially used by young children and the elderly.

Likewise, different mechanisms can be incorporated into the closure device to prevent the liquid from coming out through the air inlet orifice. These mechanisms are made up of elements that make it easier for the user or consumer to drink the liquid. Said closure devices mainly consist of elements, coupled to the body of the cap or integrated into the body of the cap, specifically one-way valves, which prevent the liquid from coming out from inside the container when the liquid is being consumed, but do allow air to enter the container to achieve smooth outlet of the liquid. In the case of elements coupled to the cap, they are made of materials with specific characteristics such as latex or silicone, whereas in the case of being integrated into the body of the cap, the material of the valve is the same as the material of the rest of the cap.

Thus, there are currently caps for bottles of the type mentioned above, for mineral water, soft drinks and isotonic drinks, which only incorporate an orifice for the outlet of liquid which is small, such that the consumer needs to suck to be able to extract the liquid or compress the receptacle or container if the material thereof allows it in order to drink directly from the stream that comes out of the liquid outlet orifice. If the consumer sucks, problems derived from said suction will arise, such as the need to stop sucking to take a breath and be able to continue drinking, and deformation due to the collapse of the container, indiscriminately wrinkling and/or becoming crushed during suction and causing a change in the shape of the container, especially when it is made of PET, which makes it difficult to hold. These problems become worse if the consumers are young children, convalescent people or the elderly who need to stop to take a breath, running the risk of ingesting a lot of liquid by not controlling the suction exerted with the consequent risk of choking. Likewise, in the caps of the state of the art, a suction effect is created when ceasing to drink, which is bothersome to the consumer.

Likewise, the cap object of the invention can also be applied to receptacles for sauces and other food products.

Caps are also known which incorporate, on the surface of the same body of the cap or closure device, an orifice for the outlet of the liquid and an orifice for the inlet of air with a valve that regulates the inlet of air into the container and prevents the liquid contained therein from coming out, or a one-way valve, said valve being integrated into the body of the cap or closure device forming a single body or part of one and the same single material, i.e., said valve is part of the same part as the cap with the outlet orifice thereof. The problem that these caps or closure devices with an orifice for the outlet of liquid from the container and an orifice for the inlet of air into the container, with or without a one-way valve, may have is that the user, when inserting the orifice for the outlet of liquid into his or her mouth, blocks the orifice for the inlet of air with their lips, thus preventing air from entering the container at the same time that the liquid comes out. This problem is especially evident in caps where the liquid outlet orifice, located in a mouthpiece, is close to the air inlet orifice since in caps of this type the user can block said air inlet orifice with his or her lips.

The object of the present invention is, therefore, a cap that comprises an air supply system which ensures the arrival of air to said orifice where the one-way valve is located, allowing air to enter the container regardless of whether the air inlet orifice is blocked or not.

DESCRIPTION OF THE INVENTION

The object of the present invention is a cap for a liquid container according to claim 1. Specifically, the cap object of the invention comprises:

- a perimeter wall that can be fit to an opening of a liquid container, and
- a first surface having at least one mouthpiece that rises from said surface and with at least one first orifice for the outlet of liquid from the container, the first surface also having at least one second orifice for the inlet of air into the container, and this second orifice having a one-way valve that allows air to enter the container, but prevents liquid from coming out, and
- an air supply system that extends from the perimeter wall to the second orifice to lead air to said second orifice from the perimeter wall.

Said air supply system can be formed by:

- Two bodies of the cap facing each other, defining a chamber or duct that communicates the aforementioned second orifice and the one-way valve with the outside, ensuring that the air reaches said second orifice, and
- A body of the cap and the user's lips, defining a chamber or duct between a channel in the body of the cap and the user's lips, such that the aforementioned second orifice and the one-way valve communicate with the outside when said second orifice is blocked by the user's lips.

Next, the different constructive alternatives of a cap with the air supply system that assures the arrival of air to said second orifice will be described.

A first alternative consists of the perimeter wall and the first surface of the cap forming a single body, said first surface comprising at least one first channel that at least partially surrounds the mouthpiece and is connected to the second orifice, said first channel being connected to the perimeter wall through at least one second channel, said channels determining the duct of the air supply system that allows air to circulate from the perimeter wall to the second orifice.

In this alternative, when the user inserts the mouthpiece into his or her mouth, his or her lips will not only block the second orifice, but they may also partially cover the first channel and even part of the second channel or channels. However, due to the depth of the channels that communicate with the second orifice and with the one-way valve not only on the surface of the latter, the circulation of air is ensured since the lips do not enter the channels, but rather remain on the surface thereof. The lips prevent the air from entering therein through the top portion of the channel, open to the outside, but they do not prevent air from entering through openings in the second channels arranged in the perimeter wall of the cap. Thus, a chamber or duct that forms the air circulation system of the cap is formed between the lips and the channels.

In another alternative, the cap is formed by two bodies instead of one, such that the first surface, with the mouthpiece and the second orifice with the one-way valve, is arranged in a first body and the perimeter wall is arranged in a second body. Said second body has a surface with a hole in which the mouthpiece is inserted so that the second body is above the first body. In this alternative, the air supply system is formed by at least one duct or chamber located between the first surface of the first body and the second surface of the second body and said duct or chamber is in communication with the outside of the cap through at least one third orifice arranged in the perimeter wall of the second body to allow air to enter said air supply system. Through said third orifices, the air enters the space between both bodies, being able to access the second orifice and one-way valve, since the second surface of said second body prevents the user's lips from coming into contact with the second orifice, as they are separated from the first surface of the first body.

With regard to this last alternative, the first surface of the first body can be substantially smooth or can have at least one first channel. If it has a first channel, it will be connected to the second orifice and also connected to the at least third orifice in the perimeter wall of the second body through at least one second channel, thus determining the air supply system, allowing air to circulate from the third orifice to the second orifice through the channels.

The second surface of the second body can also be substantially smooth or can have at least one third channel. If it has said third channel, it will be connected to the at least third orifice in the perimeter wall of the second body through at least one fourth channel, said third channel at least partially overlapping the second orifice of the second body.

According to the foregoing, it is possible to have a first body with or without channels and a second body with or without channels, being able to combine them in order to achieve a cap with an air supply system from the outside to the second orifice with a one-way valve.

In an alternative cap with a first combination of a first and second body, the second surface of the second body comprises on the underside thereof a third channel complementary to the first channel of the first body and a fourth channel complementary to the second channel of the first body determining the duct of the air supply system, the second and fourth channels being connected to the at least third orifice in the perimeter wall, allowing air to circulate from the third orifice to the second orifice through the duct of the air supply system. Thus, the first surface of the first body is in contact with the second surface of the second body over the entire area thereof except for the area occupied by the channels that determine the duct of the air supply system.

In another cap alternative with a second combination of a first and second body, the first body has the aforementioned channels and the second body has a substantially smooth surface. As in the previous case, the first surface of the first body can be in contact with the second surface of the second body over the entire area thereof except for the area occupied by the channels that determine the duct of the air supply system.

In yet another cap alternative with a second combination of a first and second body, the first body has a substantially smooth surface and the second body has the aforementioned channels. In this case, the first surface of the first body can also be in contact with the second surface of the second body over the entire area thereof except for the area occupied by the channels that determine the duct of the air supply system.

In another alternative configuration of a cap, it is possible that the first surface of the first body and second surface of the second body are not in contact. In this configuration, the duct of the air supply system is determined by the second surface of the second body, the first surface of the first body and the perimeter wall of the second body, the second surface and the first surface being separated from each other and the at least one third orifice in the perimeter wall arranged in said gap. This configuration is necessary when the surfaces of the bodies do not incorporate channels, but it is optional if said surfaces, one or both of them, incorporate said channels.

Therefore, and according to the foregoing, the air supply system, made up of the bodies or channels arranged therein, in the form of an air chamber or duct, can be determined by:

An air chamber or duct, in a cap formed by two bodies according to the present invention, determined by the first surface of the first body, the second surface of the second body and the perimeter wall of the second body, with the first surface and the second surface being separated from each other determining the air chamber or duct, connected to the outside of the cap through the at least one third orifice in the perimeter wall. Thus, the gap between the first and second surfaces of the first and second body, respectively, is greater than the height of the at least said third orifice.

An air chamber or duct, in a cap formed by two bodies according to the present invention, determined by the first surface of the first body with at least one first channel connected to the second orifice determining the chamber and also connected to the at least third orifice in the perimeter wall through at least one second channel, allowing air to circulate from the third orifice to the second orifice through the first and second channels. The duct or chamber can also be determined if third and fourth channels are arranged in the second body.

Preferably, in this alternative, the second surface of the second body is in contact with the first upper surface of the first body over the entire area thereof except for the area occupied by the channels that thus determine the air chamber. In any case, said surfaces could also be separated from each other.

These channels increase the volume of the air chamber and help direct air from the third orifice or orifices to the second orifice.

An air chamber or duct, in a cap formed by two bodies according to the present invention, determined by the second surface of the second body that has on the underside thereof a third channel complementary to the first channel of the first body and a fourth channel complementary to the first channel of the first body, both channels determining the air chamber, such that the second and fourth channels are connected to the at least the third orifice in the perimeter wall, allowing air to circulate from the third orifice to the second orifice through the aforementioned complementary channels, first and third channels and second and fourth channels. Preferably, in this alternative, the second surface of the second body is in contact with the first upper surface of the first body over the entire area thereof except for the area occupied by the channels that thus determine the air chamber, although the surfaces could also be separated from each other.

An air duct or chamber, in a cap formed by a single body according to the present invention, determined by the channels of the first body and the user's lips on said channels.

In general, the perimeter wall of the first body will have as many third orifices as necessary to guarantee the inlet of air into the chamber. Preferably, four third equidistant orifices will be arranged in said perimeter wall. Likewise, the third orifices may have the same shape and size or different shapes and sizes.

The first and third channels, either in the first body or second body of caps made up of two bodies, or the first channels in the cap of a single body, preferably surround the mouthpiece.

In the caps made up of two parts or bodies, the second surface of the second body may have a slot separated from the hole wherein the mouthpiece is inserted. This slot is preferably aligned with the second orifice of the first surface, either to facilitate air access in the event that the user does not block said slot or to allow the passage therethrough of a projection that blocks the second orifice when the cap is not in use.

The cap may have a cover or lid to cover the orifices when it is not in use. Said cover or lid can have internal projections intended to block the first orifices, the second orifices and the slots. Said cover or lid is preferably attached, in the case of a cap with two bodies, to the second body. If the cap only has one body, the cover or lid will be attached to it.

The cap preferably has coupling means for coupling to the container, specifically to the opening of said container. Said coupling means are preferably integrated into the perimeter wall. More preferably, said coupling means are a thread for fitting thereof to the container located on the perimeter wall of the cap. More preferably, said thread is located inside the perimeter wall, although it could be located outside it.

Preferably, the liquid outlet orifice is open, although it may have some type of valve, for example, made of latex or silicone to regulate the outlet of the liquid when sucking.

In order to use the variant of the cap with two bodies object of the present invention, the user inserts the liquid outlet mouthpiece into his or her mouth, and to guarantee that the air can access the second air inlet orifice, even in caps with an air inlet slot in the first surface that can be blocked by the user's lips, the air enters the air chamber arranged between the two bodies making up the cap through the third orifices in the perimeter wall of the first body. Thus, when the user sucks the liquid through the first orifice, the air is introduced through the third orifices of the first body, reaches the air chamber and from there it reaches the second orifice through which it is introduced into the container.

As mentioned, the second air inlet orifice has a one-way valve that allows air to enter the container, but prevents the liquid from coming out of said container. This valve is preferably built into the body of the second surface and is made of the same material as said body. Alternatively, it can be an element added to said second body made of a material such as silicone or latex. This valve prevents the liquid from coming out of the second orifice when the user stops sucking through the first orifice and the container is turned.

In the preferred variant where the valve is made of the same material as the body of the second surface and is integrated into the same, this material will be rigid or semi-rigid plastic, preferably polyethylene, with high resistance and low or zero elasticity, mainly compared to latex-type or silicone-type materials, which do have significant elasticity. Likewise, when the cap comprises two bodies, the first body will also be made of rigid or semi-rigid plastic, preferably of the polyethylene type, with high resistance and low or zero elasticity, mainly compared to latex-type or silicone-type materials, which do have significant elasticity.

The one-way valve or air regulator allows, as mentioned, air to enter during suction of the liquid contained inside the receptacle or container but prevents the liquid from coming out when there is no suction on the first liquid outlet orifice, in this case allowing the liquid to come out only through the orifice intended for this purpose. In other words, when the user sucks through the first liquid outlet orifice to drink, the valve opens allowing air to enter inside the container, thus making it easier to drink the liquid. The cap with a one-way valve allows, when compressing the receptacle, a stream of liquid to come out through the first liquid outlet orifice, keeping the valve closed and preventing both the liquid from coming out due to the precision exerted by the liquid on the valve and air from entering the receptacle through the second air inlet orifice.

Preferably, said one-way or regulation valve, described in patent application EP2743201A1, is made of the same rigid or semi-rigid material with low or zero elasticity in the solid state like the rest of the second body, and is made up of a tubular, but not necessarily cylindrical, body with two ends, such that a first end is in contact with the bottom surface of the cap, with the walls of the tubular body or duct surrounding the air inlet orifice on the underside of the cap, and the second free end opposite to the first end has the walls thereof in contact with each other, closing the tubular body, such that a cross-section of the body of the valve in the closed position has an approximately triangular shape. Thus, when fitting the cap on the container, said tubular body is inserted therein, such that in the resting position, the tubular body integral with the bottom surface of the cap is closed at the free end thereof and in the operating position, when a person is drinking, said free end opens allowing air to circulate towards the inside of the container, having an approximately rectangular cross-section.

The cap, mainly the first body thereof, is substantially cylindrical for coupling to the opening of a liquid container, usually also cylindrical. In any case, shapes other than a cylindrical shape can also be considered by adapting the coupling means between the first body and the container. The cap fits on the container through the coupling means, which are preferably a thread, or pressure elements and which are preferably arranged on the inner surface of the side or perimeter wall of the cap, as mentioned above.

The bodies of the cap are manufactured using a single-step injection process from a single mould. Likewise, the second body of the cap, if it incorporates the valve, can be made of two different materials, or at least two materials, but with similar properties and, in particular, similar rigidity, which form a single body with the valve integrated therein. Once both bodies have been manufactured, they are coupled by inserting the mouthpiece of the first body into the second body through the hole in the latter.

Preferably, the cap object of the present invention has a diameter of approximately 3.2 cm, a typical diameter in 0.33 and 0.5 litre receptacles that contain water, and the distance between the axis of the liquid outlet orifice and the axis of the air inlet orifice is approximately 1.3 cm, this distance being able to vary between 1 and 1.5 cm.

The cap object of the present invention is preferably applied to bottles for water or soft drinks, although it can also be used for the consumption of isotonic drinks. Likewise, the cap object of the invention can also be applied to receptacles for sauces and other food products.

Preferably, the material used for manufacturing the cap object of the present invention is a low-density polyethylene or polypropylene resin, with a density between 0.85 and 1.2 g/cm3, more preferably between 0.9 and 0.95 g/cm3. Some of the materials that can be used, among others, are PP575P or PP412MN40 by SABIC, PR280P1M by ISPLEN (REPSOL) or IDPE LD 104BR by ExxonMobil, as well as polymaterials and biocompostable materials.

DESCRIPTION OF THE DRAWINGS

As a complement to the description of the object of the invention being made and for the purpose of helping to make the features that distinguish it more readily understandable, this specification is accompanied by the figures which, by way of illustration and not limitation, represent the following.

PREFERRED EMBODIMENTS OF THE INVENTION

Figure 1:
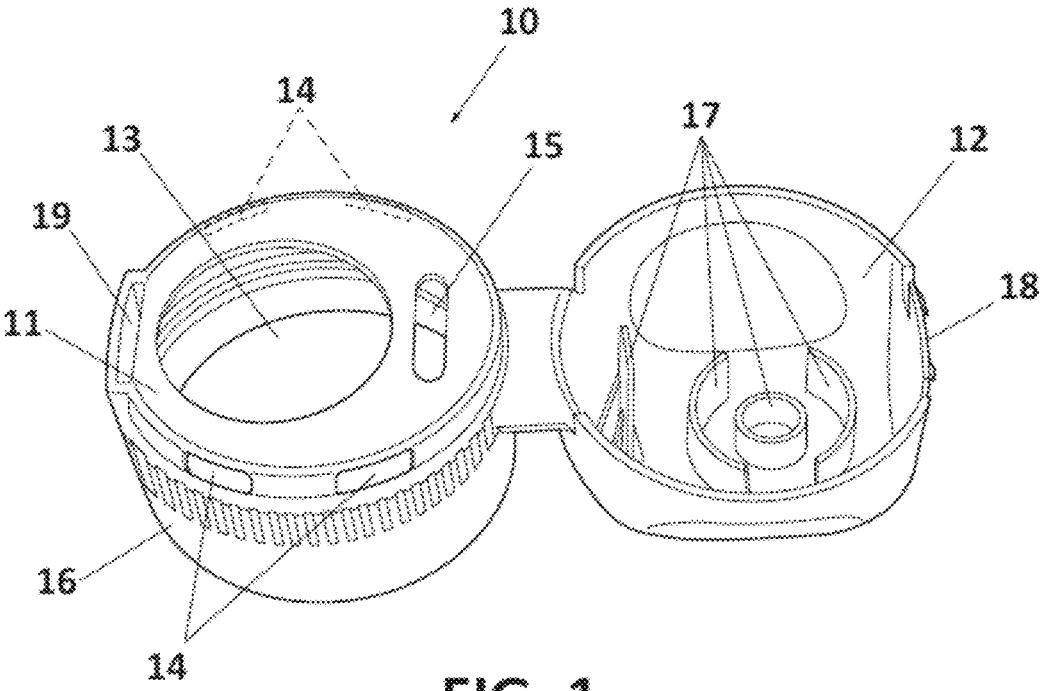
FIG. 1 shows a top perspective view of a first embodiment of a second body of the cap with cover object of the present invention.

In view of the aforementioned figures, and in accordance with the adopted numbering, one may observe therein preferred exemplary embodiments of the invention, which comprise the parts and elements described in detail below. Thus, in the figures, up to five preferred embodiments of a cap object of the present invention are observed.

As can be seen in said figures, the cap of a liquid container, receptacle or bottle, object of the present application, generally comprises:

- a perimeter wall (16, 106, 516) that can be fit to an opening of a liquid container,
- a first surface (25, 205, 525) having at least one mouthpiece (24, 204, 524) that rises from said surface (25, 205, 525) and with at least one first orifice (21, 201, 521) for the outlet of liquid from the container, the first surface (25, 205, 525) also having at least one second orifice (22, 202, 522) for the inlet of air into the container, and this second orifice (22, 202, 522) having a one-way valve (23, 203, 523) that allows air to enter the container, but prevents liquid from coming out, and
- an air supply system (40, 41, 42, 43, 44) that extends from the perimeter wall (16, 106, 516) to the second orifice (22, 202, 522) to lead air to said second orifice (22, 202, 522) from the perimeter wall (16, 106, 516).

Figure 16:
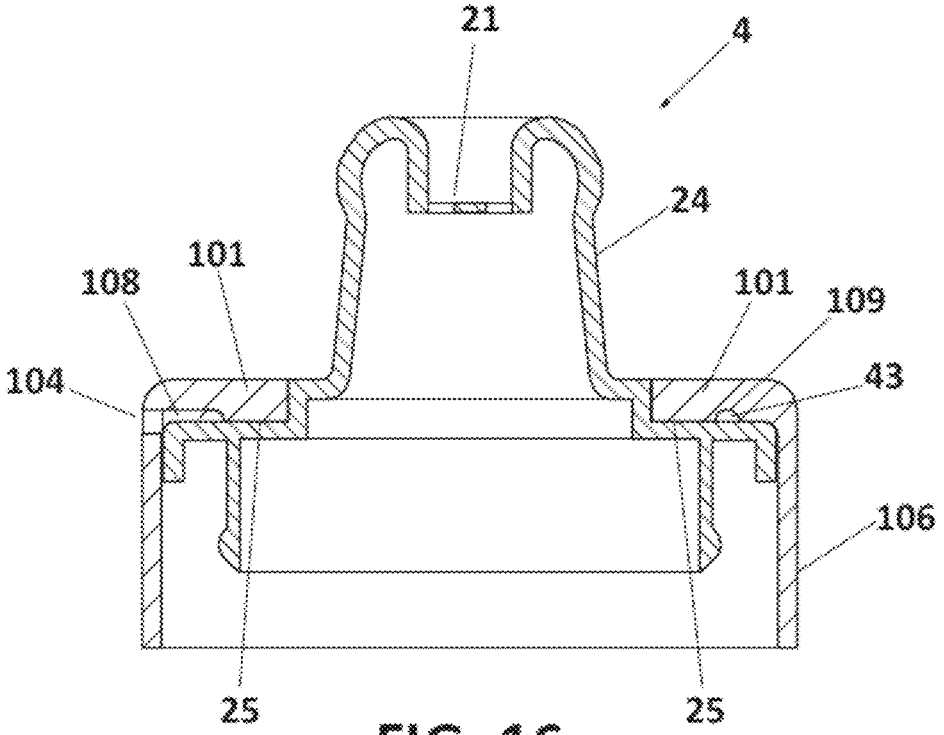
FIG. 16 shows a cross-section of a fourth embodiment of the cap.
Figure 17:
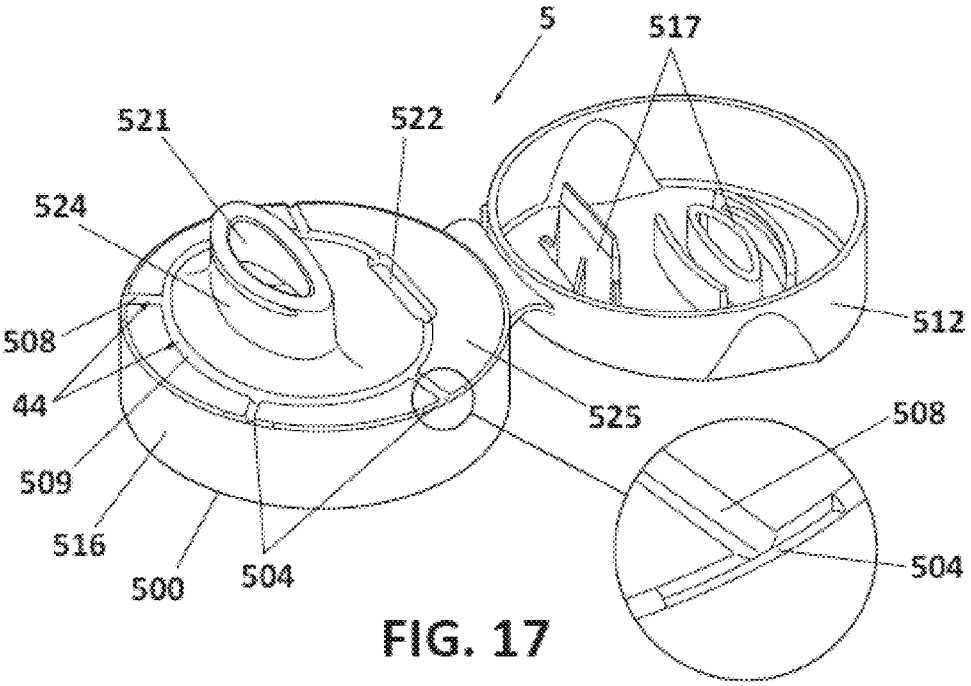
FIG. 17 shows a top perspective view of a fifth embodiment of a cap of a single body according to the invention.
Figure 18:
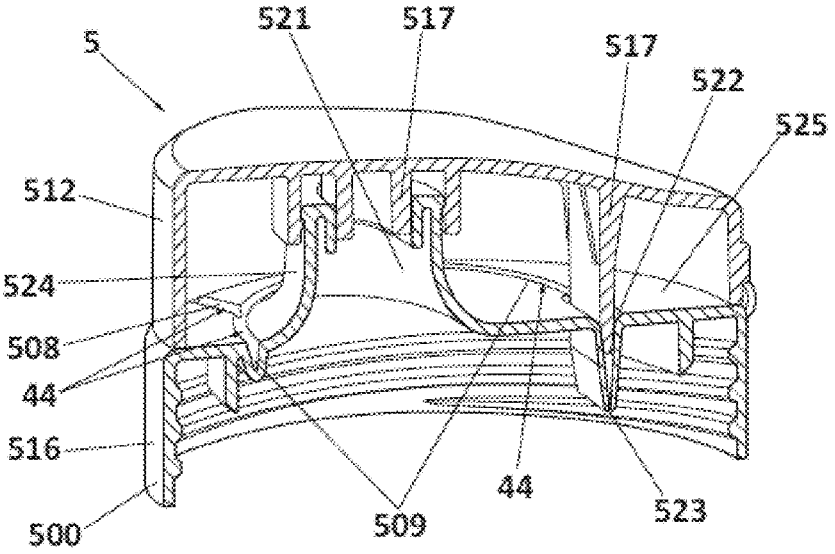
FIG. 18 shows a perspective cross-section of the fifth embodiment of the cap of a single body.

The present invention shows in FIGS. 1 to 16 thereof various examples of caps comprising two bodies, a first body (20, 200) and a second body (10, 100), whereas FIGS. 17 and 18 show an exemplary embodiment with a single body (500).

The examples in FIGS. 1 to 16 have a cap where:

- The first surface (25, 205) is arranged in a first body (20, 200),
- The perimeter wall (16, 206) is arranged in a second body (10, 100) formed by a second surface (11, 101) with a hole (13, 103) to insert the mouthpiece (24, 204) of the first body (200), and
- The air supply system (40, 45) is at least one duct (108, 109, 204, 209) located between the first surface (25, 205) of the first body (20, 200) and the second surface (11, 101) of the second body (10, 100), in communication with the outside of the cap through at least one third orifice (14, 104) arranged in the perimeter wall (16, 106) of the second body (10, 100) to allow air (A) to enter said air supply system (40, 45).

In these FIGS. 1 to 16, up to four embodiments of the invention are shown, in which the air chamber 40, 41, 42, 43 is arranged between the second surface 11 of the second body 10, 100 and the first surface 25, 205 of the first body 20, 200, the air chamber 40, 41, 42, 43, 44 being connected to the outside of the cap, when said cap is coupled to a container 30 through third orifices 14, 104 arranged in the perimeter wall 16, 106 of the first body.

Figure 3:
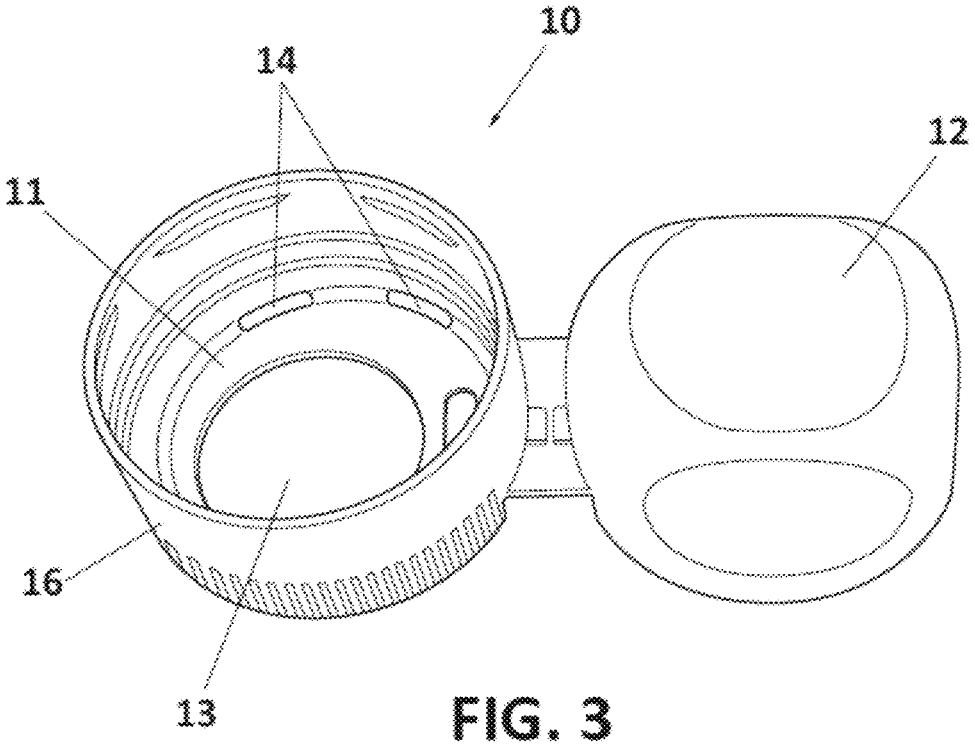
FIG. 3 shows a bottom perspective view of the second body of the cap of FIG. 1.

More particularly, FIGS. 1 and 3 show a first embodiment of a second body 10, which has a second surface 11, substantially flat or smooth, surrounded by a perimeter wall 16 that incorporates means (not shown) for the coupling thereof to the opening of a container or receptacle 30 containing the liquid to be administered through the cap object of the present invention. Said second surface 11 has a hole 13 and preferably a slot 15 close to the hole 113. Likewise, the perimeter wall has at least one third orifice 14, preferably four, arranged separately in said perimeter wall 16. The first body can incorporate a cover or lid 12 that fits over said first body 11, blocking the different orifices 15, 14. Said cover or lid 12 can incorporate internal projections 17 that are inserted at least partially into the different orifices of the cap to block the same. The cover or lid 12 can comprise closing means 18 that are complemented by closing means 19 in the first body 11. In this example, a flange-like projection 18 is shown which is inserted into a recess 19. The material of the second body 10 of the cap is preferably a rigid or semi-rigid plastic in the solid state, preferably polyethylene, and although flexible, it is not elastic in said state.

Figure 2:
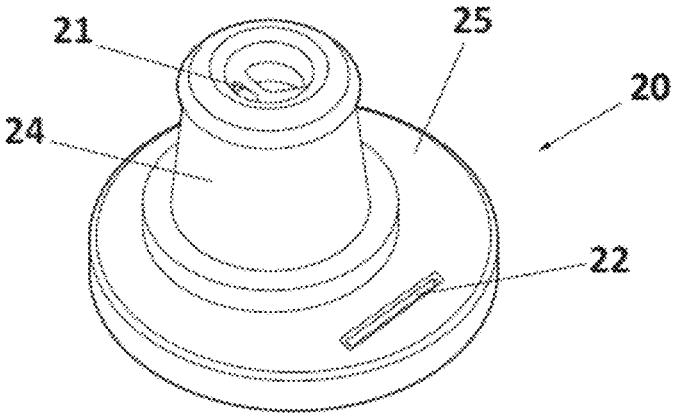
FIG. 2 shows a top perspective view of a first embodiment of a first body of the cap object of the present invention.
Figure 4:
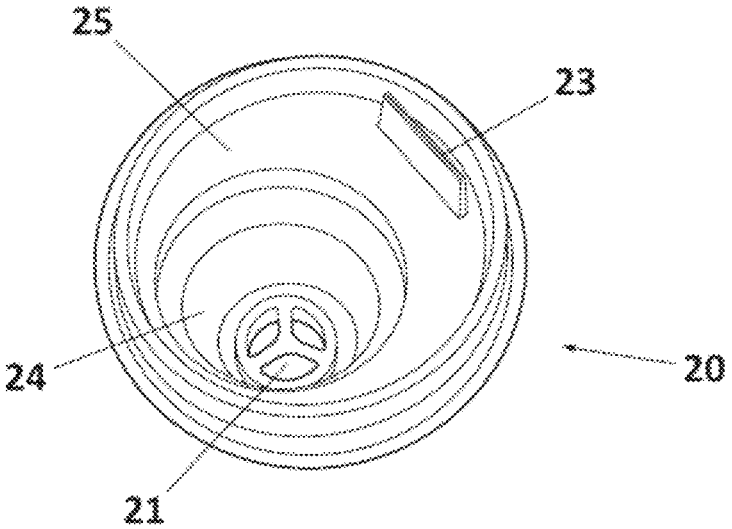
FIG. 4 shows a bottom perspective view of the first body of the cap of FIG. 2.

A first embodiment of a first body 20 shown in FIGS. 2 and 4 has a mouthpiece 24 that emerges from a first surface 25, substantially flat or smooth, and has a first liquid outlet orifice 21 arranged at the free end of the mouthpiece 24. This first body has a second orifice 22 for the inlet of air, which in this example is in the form of a slot. This second air inlet orifice 22 also has a one-way valve 23 in the bottom portion of the first surface 25, the bottom portion that will face the housing of the container or receptacle 30 once the cap has been coupled to it. In this example, the valve 23 forms part of the second body 20 of the cap 1, as it is made of the same material as said cap and in the same manufacturing process. The material of the first body 20 of the cap is preferably a rigid or semi-rigid plastic in the solid state, preferably polyethylene, and although flexible, it is not elastic in said state. In any case, a first body 20 would also be possible with two or more materials, at least one for the first body 20 and another for the valve, and it can be manufactured in a single injection or two, provided that they allow the manufacture of the first body 20 in such a way that the components form a single body or part.

The one-way valve 23 consists of, in an exemplary embodiment, a tubular body that forms part of the first body 20 of the cap, with the walls of the first end of said tubular body surrounding the air inlet orifice 22 and the walls of the second end of said body being in contact with each other, closing the duct of the valve 23. The one-way valve could alternatively be made up of a silicone or latex element coupled to the first body 20 and coinciding with the second orifice 22.

Figure 5:
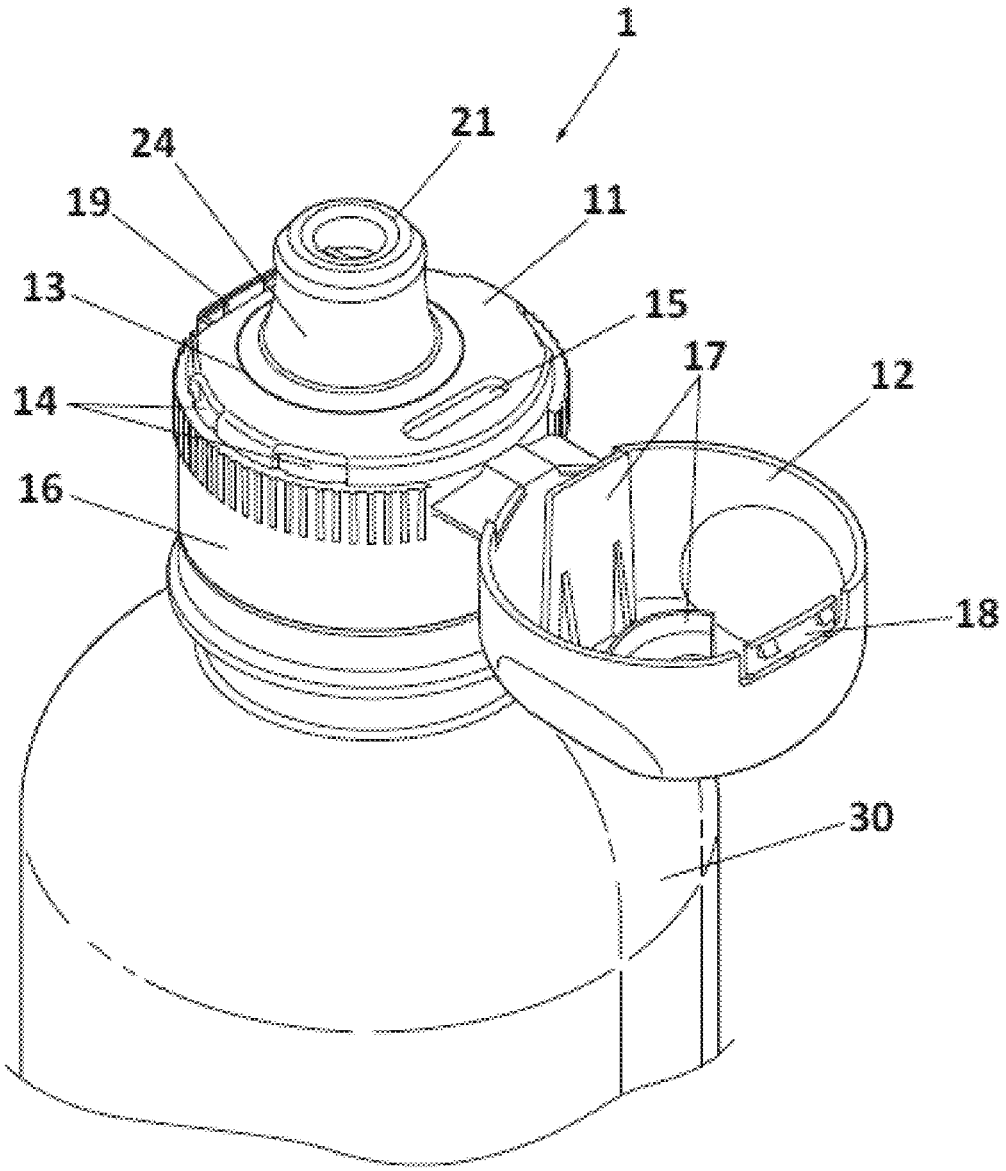
FIG. 5 shows a top perspective view of an exemplary embodiment of the cap object of the invention coupled to a liquid container, bottle or receptacle.

FIG. 5 shows an exemplary embodiment of a cap 1 of the invention with the first body 20 coupled to the second body 10 after inserting the mouthpiece 24 of the first body 20 into the hole 13 of the second surface 11 of the second body 10. The base of the mouthpiece 24 on the first surface of the first body 20 is fitted to the hole 13 of the second surface of the first body 10, thus forming the cap 1. The slot 15 of the second surface 11 of the second body 10 is aligned with the second air intake orifice 22 on the first surface 25 of the first body 20. This slot 15 is optional.

The second body 11 of the cap 1 has as fixing means for fixing to a container, receptacle or bottle 30, a thread inside the perimeter wall 16 of the second body 10 to be fit to the neck or opening of the container, receptacle or bottle 30 as well as a lid or cover 12 integral with the second body 10 of the cap 1. As mentioned, the lid 12 can incorporate projections therein that adapt to the liquid outlet orifice or orifices 21, as well as projections 17 that adapt to the air inlet orifice or orifices 22. For the projection 17 to be able to adapt to the second air inlet orifice 22, it is necessary for there to be a slot 15 in the first surface 11 so that said projection 17 can be inserted into the slot 22.

Figure 6:
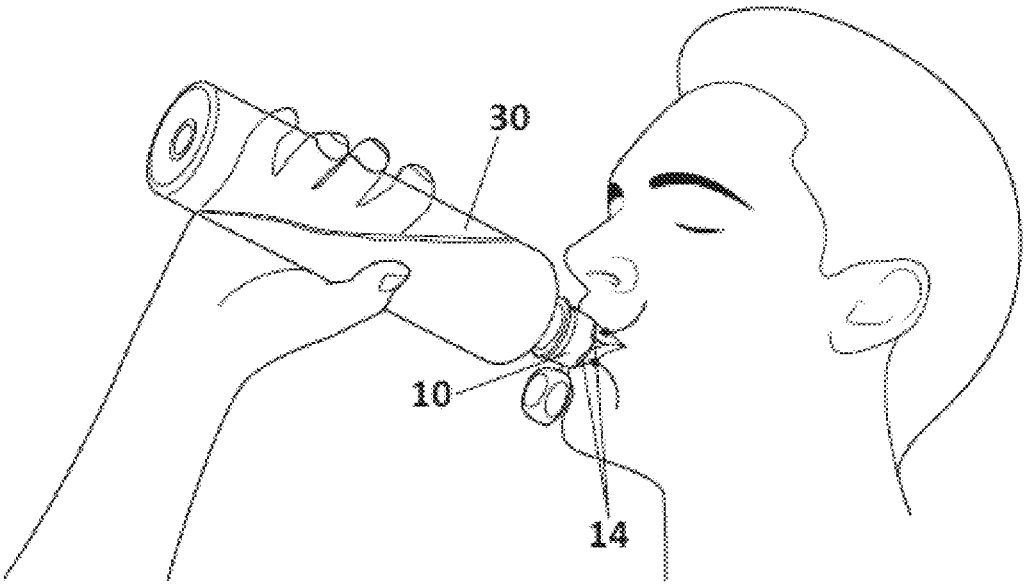
FIG. 6 shows a user using an exemplary embodiment of a cap object of the invention coupled to a container or receptacle with liquid.

FIG. 6 shows a user drinking from a bottle or container 30 with a cap object of the invention. The cap allows the beverage inside the bottle 30 to be consumed comfortably and without the risk of the liquid coming out the same through the second air inlet orifice 22, since it has a one-way valve. Thus, a consumer will suck through the first liquid outlet orifice 21 of the mouthpiece 24, creating a depression inside the container or bottle 30 that will cause the one-way valve 23 to open and therefore air to enter inside the container or bottle 30. When no depression is created, because there is no suction, the valve 23 closes and remains in this situation.

Figure 7:
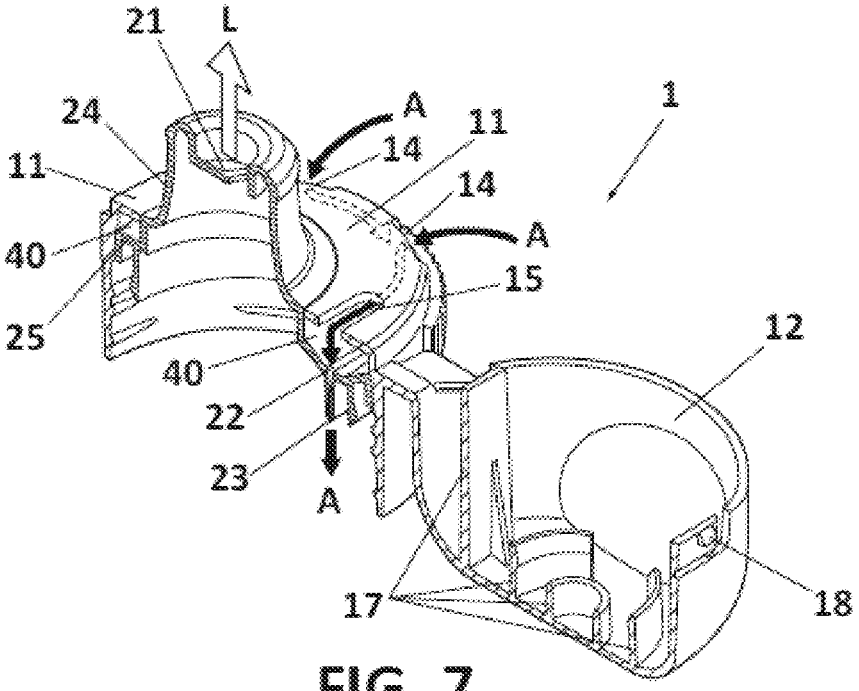
FIG. 7 shows a perspective cross-sectional view of a first embodiment of the cap object of the invention incorporating the air and liquid flows during use of the same.

FIG. 7 shows a perspective cross-section of an exemplary embodiment of the cap 1 of the invention with the first body 20 coupled to the second body 10. To ensure the operation of the cap 1 as described, it is necessary to ensure that the air A reaches the second air A inlet orifice 22, and therefore the valve 23, arranged in the first body 20 of the cap 1 while that the user is sucking through the first liquid L outlet orifice 21. The natural access of air A to the second air A inlet orifice 22 is the slot 15 arranged in the first body 10, but this slot 15 can be blocked by the user's lips when said user inserts the mouthpiece 24 into his or her mouth to suck the liquid L through the first orifice 21.

Thus, in the event that this slot 15 is blocked or this slot 15 is not provided in the first body, it is necessary to facilitate the access of air A to the second air A inlet orifice 22, which is achieved given the situation of the third air A inlet orifices 14 inside the cap. These third orifices 14 provide access to an air chamber 40 formed when a duct is created between the second body 10 and the first body 20, specifically, between the second surface 11 of the second body 10, the first surface 25 of the first body 20 and the perimeter wall 16 of the second body. In this way, the cap 1 allows, as already described above, the beverage inside the bottle 30 to be consumed comfortably and without the risk of the liquid coming out of the bottle 30 through the second air inlet orifice 22. When a consumer or user wishes to drink directly from the bottle 30, he or she can either suck or drink from the stream of beverage.

If the user sucks through the first liquid L outlet orifice 21 through the mouthpiece or spout 23, a depression is created inside the bottle 30 that causes the one-way valve 23 to open, thus allowing air A to enter inside the bottle as said air passes through the third orifices 14, reaches the air chamber 40 and from there reaches the second orifice 22 to, after passing through the valve 23, reach the inside of the bottle 30. The greater the suction, the greater the opening of the valve 23, the greater the air A inlet and, therefore, the greater the liquid L outlet will be. On the contrary, the same thing happens, since when no depression is generated, because there is no suction, the valve 23 closes.

If the user wishes to drink from a stream of the beverage, i.e., directly from the stream that comes out through the first liquid L outlet orifice 21 of the cap 1, he or she can compress said bottle 30 externally if the bottle 30 allows so, such that the valve 23 is sealed by the compressing action of the liquid L inside the bottle 30 on the same, forcing the liquid 30 to come out through the first liquid L outlet orifice 21, as if the cap 1 only incorporated a single orifice in the surface thereof.

The operation of the cap object of the invention described above for the exemplary embodiment of FIGS. 1 to 7 is also applicable to the exemplary embodiments of the caps 2, 3, 4, 5 that are described below, as well as in FIGS. 8 to 18.

Figure 8:
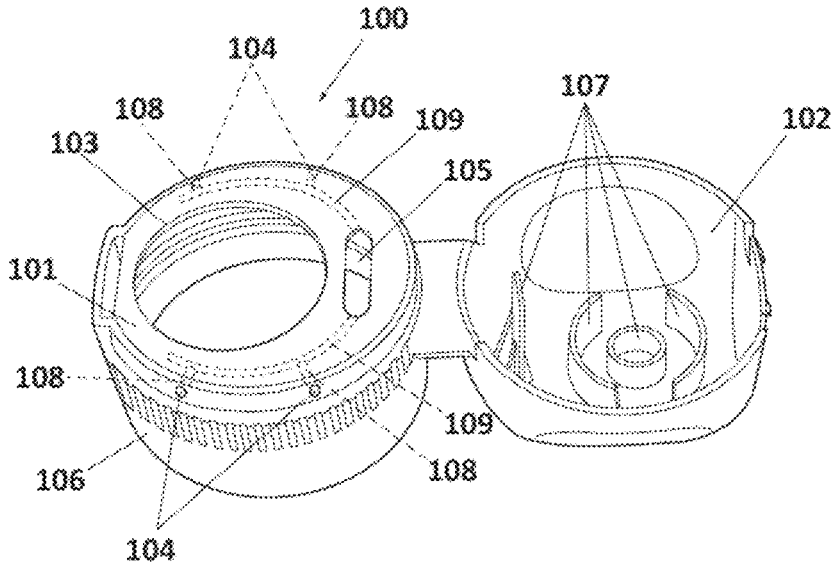
FIG. 8 shows a top perspective view of a second embodiment of a second body of the cap with cover object of the present invention.
Figure 10:
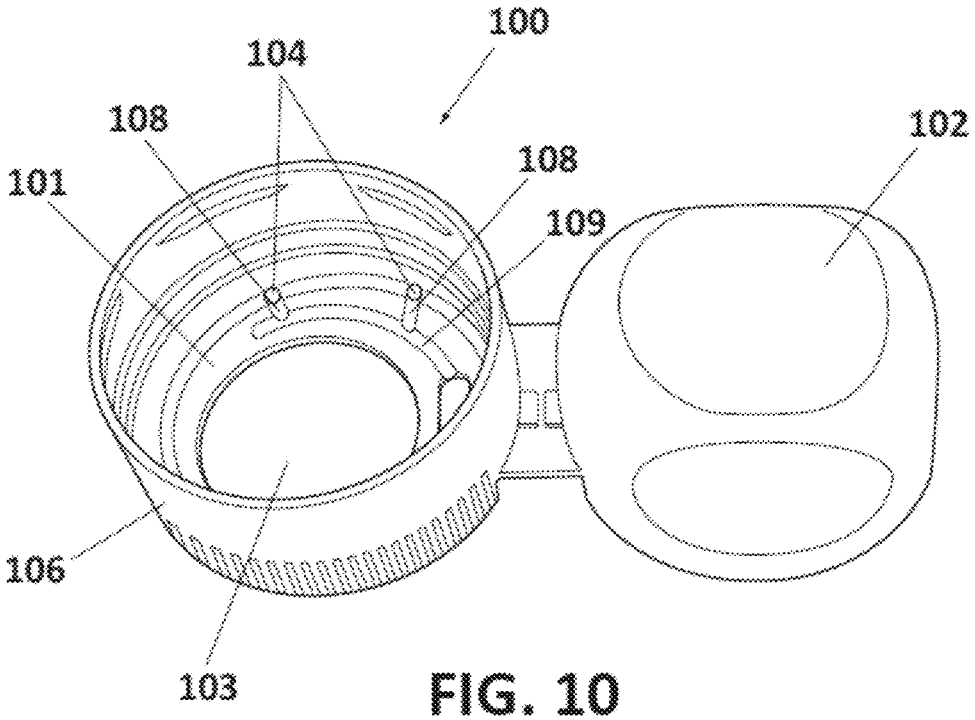
FIG. 10 shows a bottom perspective view of the second body of the cap of FIG. 8.

Thus, FIGS. 8 and 10 show a second embodiment of a second body 100 of a cap object of the invention. Said second body 100 has on the underside of the second surface 101 thereof a third channel or channels 109 that extend near, or around, the hole 103 and are connected to third orifices 104 arranged in the perimeter wall 106 of the first body 100 through fourth channels 108. If the second body 101 incorporates a slot 105 in the first surface 101 thereof, the third channels 109 will describe the trajectory thereof near the hole 103 from said slot 105. The second body 100 can incorporate a cover or lid 102 that can have projections 107 depending on the orifices to be blocked in the cap. Said third channels 109 and fourth channels 108 preferably have a semicircular cross-section, although they could also be square or triangular, for example.

Figure 9:
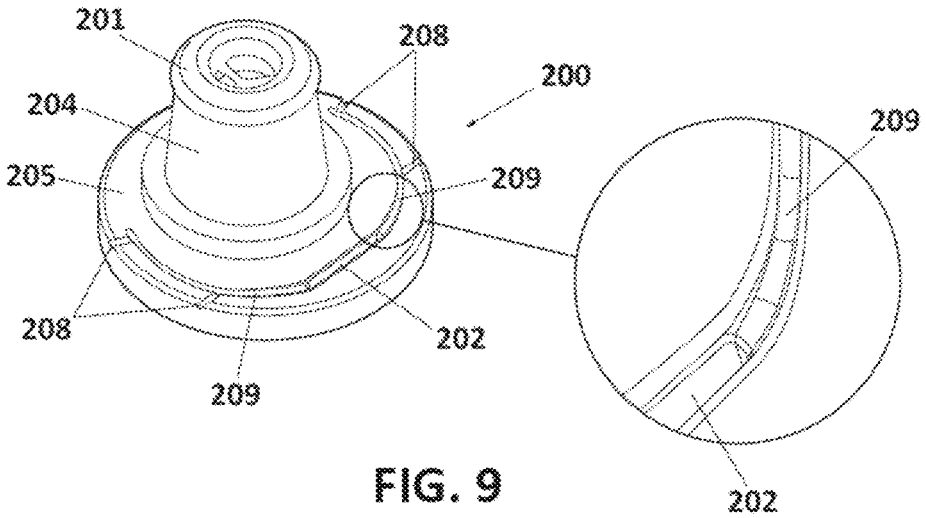
FIG. 9 shows a top perspective view of a second embodiment of a first body of the cap object of the present invention.

FIG. 9 shows a second exemplary embodiment of a first body 200 of a cap. It incorporates a first channel or channels 209 in the top side of the first surface 205 that preferably extend near, or around, the base of the mouthpiece 204 from the second air inlet orifice 202 arranged in the first surface 205 of the first body 200. Said first channels 209 connect to the periphery or perimeter of the first body 200 through second channels 208. Said first channels 209 and second channels 208 preferably have a semicircular cross-section, although it could also be square or triangular, for example.

The first bodies 20, 200 and second bodies 10, 100 can be combined with each other indistinctly to form different caps. Sometimes it may be necessary to make small modifications for the correct coupling between the two bodies. FIGS. 11 to 16 show cross-sections of four different examples of caps 1, 2, 3, 4 formed by the coupling of the first bodies 20, 200 and second bodies 10, 100.

Figure 11:
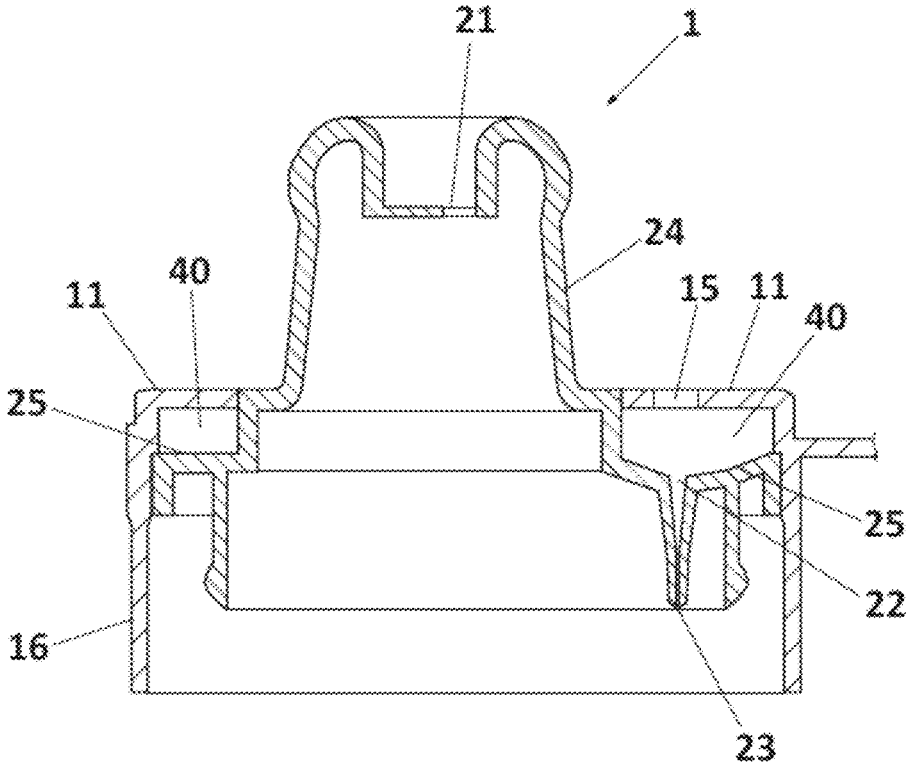
FIG. 11 shows a first cross-section of a first embodiment of the cap.
Figure 12:
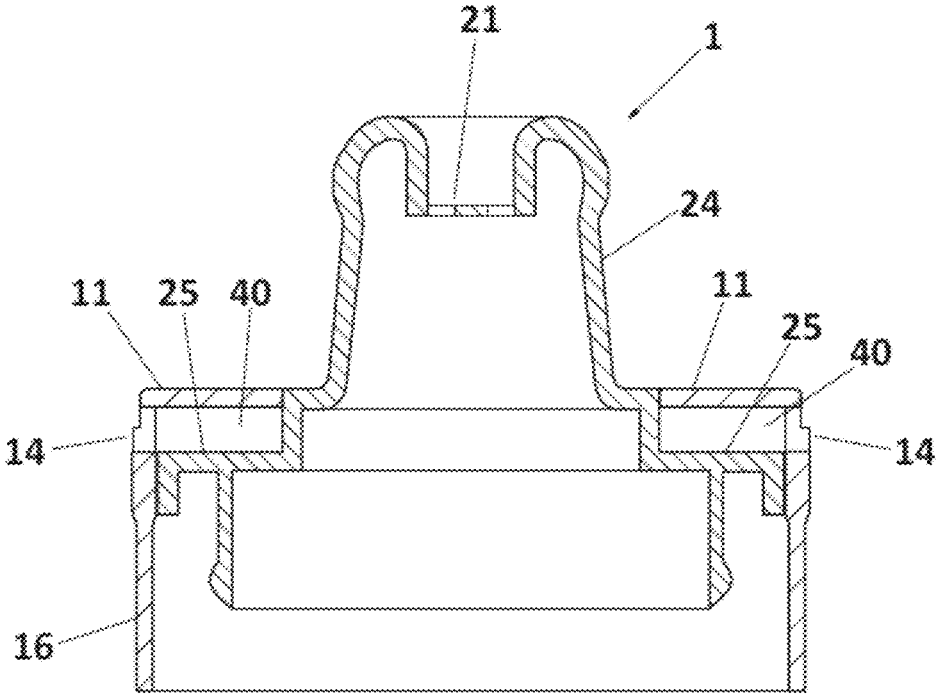
FIG. 12 shows a second cross-section of a first embodiment of the cap.

FIGS. 11 and 12 show a cap 1 formed by the first exemplary embodiment of the first body 20 (FIGS. 2 and 4) coupled to the first exemplary embodiment of the second body 10 (FIGS. 1 and 3). There is a fit between the perimeter of the mouthpiece 24 and the hole 13 in the second body 10. Specifically, they are two cross-sections of the cap 1 in FIG. 7. In these cross-sections, the air supply system 40 can be seen in the form of a chamber or duct arranged between the first surface 25 of the first body 20 and the second surface 11 of the second body 10 separated from each other by a distance equal to or greater than the height of the third orifices 14. Likewise, it can be seen how said chamber 40 is in communication with the outside through the third orifices 14 arranged in the second body 10 and, in turn, it communicates with the second orifice 22 in the first body 20 and therefore with the one-way valve 23 formed in the first body 20 itself. In this cap 1, the second body 20 has a slot 15 aligned with the second orifice 22, but said slot 15 may not be in said second body or, on the contrary, it may be, but not aligned with the second orifice 22.

Figure 13:
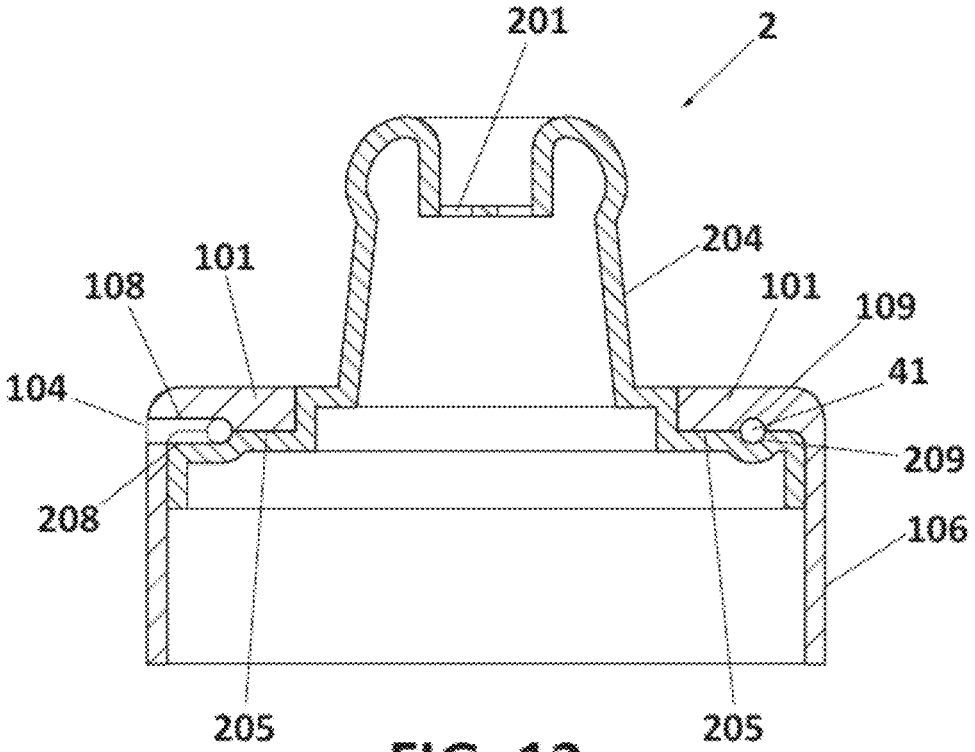
FIG. 13 shows a first cross-section of a second embodiment of the cap.
Figure 14:
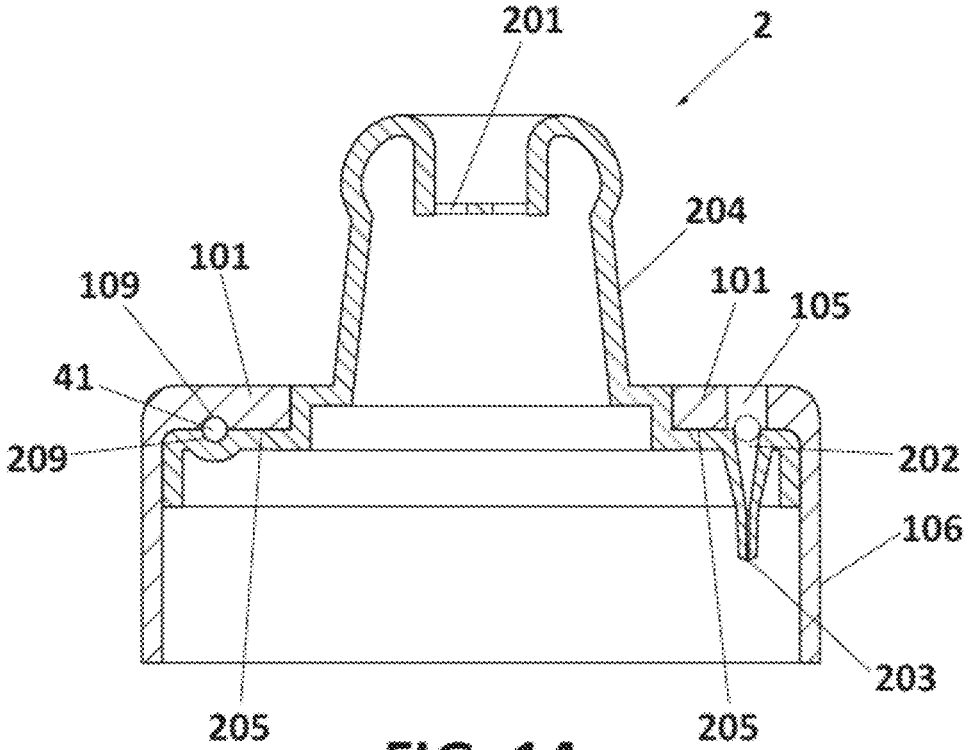
FIG. 14 shows a second cross-section of a second embodiment of the cap.

FIGS. 13 and 14 show a cap 2 formed by the second exemplary embodiment of the first body 200 (FIG. 9) and by the second exemplary embodiment of the second body 100 (FIGS. 8 and 10). There is a fit between the perimeter of the mouthpiece 204 and the hole 103 in the second body 10. In said cross-sections, the first channel 209 and second channels 208 of the first body 200 can be seen facing, respectively, the third channel 109 and fourth channels 108 of the second body 100. The attachment of the first channel 209 and third channel 109, as well as the attachment of the second channels 208 and fourth channels 108 form the air supply system 41 of the cap 2, specifically a duct or chamber that communicates the outside of the cap 2 with the second orifice 202 of the first body 200. The second channels 208 and fourth channels 108 communicate with the outside through the third orifices 104 made in the perimeter wall 106 of the second body 100. In this cap 2, the first surface 205 of the first body 200 is in contact with the second surface 101 of the first body 100 over the entire surface thereof except where the channels 208, 209, 108, 109 are located. The supply system 41, formed by the ducts which are in turn formed by the channels 208, 209, 108, 109, lead the air from the third orifices 104 to the second orifice 202 of the first body 200 where the one-way valve 203 formed in the first body 200 itself is located. In this cap 2, the second body 200 has a slot 105 aligned with the second orifice 202, but said slot 105 may not be in said second body or, on the contrary, it may be, but not aligned with the second orifice 202.

Figure 15:
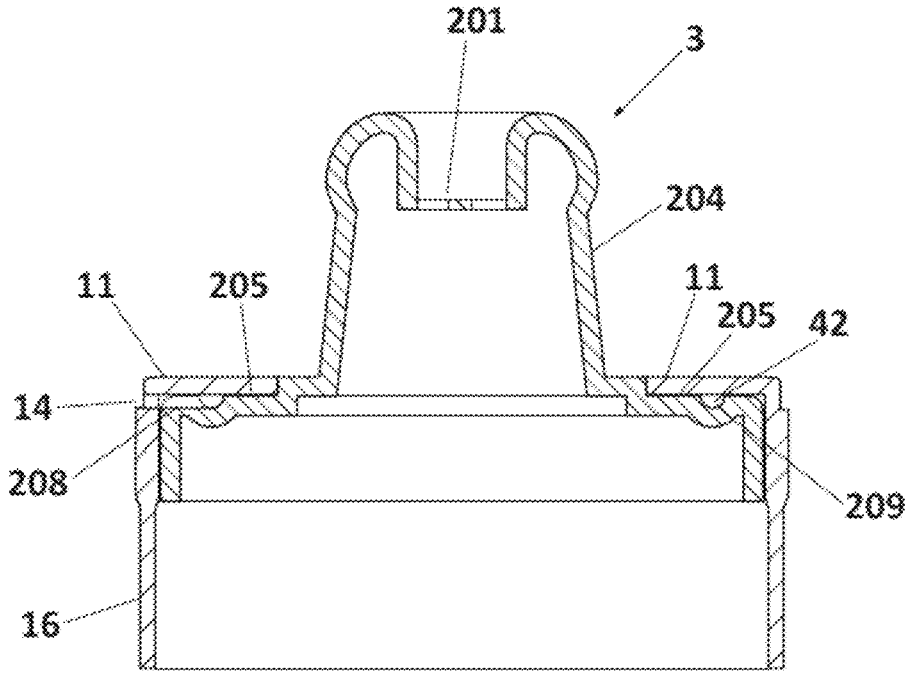
FIG. 15 shows a cross-section of a third embodiment of the cap.

FIG. 15 shows a cap 3 formed by the second exemplary embodiment of the first body 200 (FIG. 9) coupled with the first exemplary embodiment of the second body 10 (FIGS. 1 and 3). In this cap 3, the air supply system 42 of the second orifice 202, and of the one-way valve 203 (not shown), is formed by the first channel 209 and second channels 208 made in the first surface 205 of the first body 200 combined with the second surface 11 of the second body 10, the first surface 205 of the first body 200 being in contact with the entire second surface 11 of the second body 10 except where the channels 209, 208 meet. The cross-section of the channels 209, 208 can vary depending on the needs of the air flow that must circulate through the same. The second channels 208 are aligned with the third orifices 14 of the first body to allow air to enter from outside the cap 3 to the second orifice 202 and valve 203 of the first body 200.

FIG. 16 shows a cap 4 formed by the first exemplary embodiment of the first body 20 (FIGS. 2 and 4) coupled with the second exemplary embodiment of the second body 100 (FIGS. 8 and 10). In this cap 4, the air supply system 43 of the second orifice 22, and of the one-way valve 23 (not shown), is formed by the third channel 109 and fourth channels 108 made in the second surface 25 of the second body 100 combined with the first surface 25 of the first body 20, the first surface 25 of the first body 20 being in contact with the entire second surface 101 of the second body 100 except where the channels 109, 108 meet. The cross-section of the channels 109, 108 can vary depending on the needs of the air flow that must circulate through the same. The fourth channels 108 are an extension towards the inside of the second body 100 of the third orifices 104 to allow air to enter from outside the cap 4 to the second orifice 22 and valve 23 of the first body 20, since the third channel 109 passes above the second orifice 22 communicating said third channel 109 with said second orifice 22.

In the cross-sections of FIGS. 11 to 16, the cover or lid 12, 102 integral with the second body 10, 100 has not been shown. Likewise, the cross-sections of the channels have been represented as semicircular, but they could have other cross-sections with a variable depth and width depending on the needs.

FIGS. 17 and 18 show another exemplary embodiment of a cap 5 which, unlike the previous ones, is formed by a single body 500 with a perimeter wall 516 that fits into an opening of a liquid container and a first surface 525. This surface 525 has a mouthpiece 524 that rises from said surface 525 with a first orifice 521 for the outlet of liquid and also has a second orifice 522 for the inlet of air into the container. This second orifice 522 has a one-way valve 523 that allows air to enter the container, but prevents liquid from coming out. The cap has an air supply system 44 that extends from the perimeter wall 516 to the second orifice 522 to lead air to said second orifice 522 from the perimeter wall 516. Specifically, said air supply system 44 is formed by a first channel 509 that surrounds the mouthpiece 524 and second channels 508 that communicate said first channel 509 with the perimeter wall 516, specifically with openings or orifices 504 made in said wall 516. Said openings or orifices 504 have a larger cross-section than that of the second channels 508 to facilitate the inlet of air into the supply system 44. In this cap 5, when the user inserts the mouthpiece 524 into his or her mouth to drink, his or her lips will probably cover both the first channel 509 and the second air inlet orifice 522, so that the air supply system 44 will be made up of the duct formed by the user's lips and the bottom of the channels 509, 508, which will have sufficient depth to guarantee the circulation of air from the orifices or openings 504 and the second orifice 524 through the second channels 508 and the first channel 509. This cap 5 preferably has second channels 508 in communication with the first channel 509. The cap 5 also shows a cover or lid 512 integral with the body 500 of the cap with internal projections 517 intended to block the first orifice 521 located in the mouthpiece 524, as well as the second orifice 522.

The invention claimed is:

1. A cap for a liquid container comprising:

a perimeter wall to be fit to an opening of a liquid container, and a first surface having a mouthpiece that rises from said surface and with a first orifice for the outlet of liquid from the container, the first surface also having a second orifice for the inlet of air into the container, and the second orifice having a one-way valve that allows air to enter the container, but prevents liquid from coming out, the cap further comprises an air supply system that extends from an aperture arranged in the perimeter wall to the second orifice to lead air to said second orifice from the perimeter wall.

2. The cap, according to claim 1, wherein:

the first surface is arranged in a first body, the perimeter wall is arranged in a second body formed by a second surface with a hole to insert the mouthpiece of the first body, and the air supply system comprises a duct located between the first surface of the first body and the second surface of the second body, in communication with the outside of the cap through the aperture arranged in the perimeter wall of the second body to allow air (A) to enter said air supply system.

3. The cap, according to claim 2, wherein the first surface of the first body comprises a first channel connected to the second orifice and also connected to the aperture in the perimeter wall through a second channel, determining the air supply system allowing air (A) to circulate from the aperture to the second orifice through the channels.

4. The cap, according to claim 2, wherein the second surface of the second body comprises on the underside thereof a third channel following the aperture in the perimeter wall through a fourth channel, said third channel determining the air supply system.

5. The cap, according to claim 3, wherein the second surface of the second body comprises on the underside thereof a third channel complementary to the first channel of the first body and a fourth channel complementary to the second channel of the first body determining the duct of the air supply system, the second channel and fourth channel being connected to the aperture in the perimeter wall, allowing air (A) to circulate from the aperture to the second orifice through the duct of the air supply system.

6. The cap, according to claim 3, wherein the first surface of the first body is in contact with the second surface of the second body over an entire area thereof except for an area occupied by the channels that determine the duct of the air supply system.

7. The cap, according to claim 2, wherein the duct of the air supply system is determined by the second surface of the second body, the first surface of the first body and the perimeter wall of the second body, the second surface and the first surface being separated from each other forming a gap and the aperture in the perimeter wall arranged at said gap.

8. The cap, according to claim 1, wherein the perimeter wall and the first surface form a single body, said first surface comprising a first channel that at least partially surrounds the mouthpiece and connected to the second orifice, said first channel being connected to the perimeter wall through a second channel, said channels determining the duct of the air supply system that allows air (A) to circulate from the perimeter wall to the second orifice.

9. The cap, according to claim 2, wherein the second surface of the second body has a slot separated from the hole.

10. The cap, according to claim 9, wherein the slot is aligned with the second orifice of the first surface of the first body.

11. The cap, according to claim 1, comprising coupling means for coupling to said container which are integrated in the perimeter wall.

12. The cap, according to claim 11, wherein said coupling means are a thread for fitting thereof to the container located on the perimeter wall of the cap.

13. The cap, according to claim 1, comprising a cover or lid.

14. The cap, according to claim 13, wherein the cover or lid has internal projections configured to block the first orifice and the second orifice.

15. The cap, according to claim 1, wherein the first orifice is open.

* * * * *